US010480400B2

(12) United States Patent
Plante

(10) Patent No.: US 10,480,400 B2
(45) Date of Patent: Nov. 19, 2019

(54) AIR SUPERCHARGING DEVICE FOR AN INTERNAL COMBUSTION ENGINE

(71) Applicant: Nissan Motor Co., Ltd., Yokohama-shi, Kanagawa (JP)

(72) Inventor: Francois Plante, Champcueil (FR)

(73) Assignee: Nissan Motor Co., Ltd., Yokohama (JP)

( * ) Notice: Subject to any disclaimer, the term of this patent is extended or adjusted under 35 U.S.C. 154(b) by 22 days.

(21) Appl. No.: 16/066,436

(22) PCT Filed: Feb. 6, 2017

(86) PCT No.: PCT/FR2017/050266
§ 371 (c)(1),
(2) Date: Jun. 27, 2018

(87) PCT Pub. No.: WO2017/137687
PCT Pub. Date: Aug. 17, 2017

(65) Prior Publication Data

US 2019/0153934 A1 May 23, 2019

(30) Foreign Application Priority Data

Feb. 8, 2016 (FR) ..... 16 50972

(51) Int. Cl.

| | |
|---|---|
| ***F02B 39/00*** | (2006.01) |
| ***F02B 39/10*** | (2006.01) |
| ***F04D 17/10*** | (2006.01) |
| ***F01D 25/12*** | (2006.01) |
| ***F01P 5/04*** | (2006.01) |

(52) U.S. Cl.
CPC ..... *F02B 39/005* (2013.01); *F01D 25/12* (2013.01); *F01P 5/04* (2013.01); *F02B 39/10* (2013.01); *F04D 17/10* (2013.01); *F01P 2060/12* (2013.01)

(58) Field of Classification Search
CPC ..... F01D 25/12; F01P 2060/12; F01P 5/04; F02B 39/005; F02B 39/10; F04D 17/10; F04D 25/06; F04D 29/5806; F04D 29/5813
See application file for complete search history.

(56) References Cited

U.S. PATENT DOCUMENTS 3,741,677 A * 6/1973 Silvern ..... F04D 17/12 415/58.1
6,158,422 A * 12/2000 Blank ..... F01N 3/28 123/559.2
6,257,834 B1 * 7/2001 Bremer ..... F01D 25/12 415/176

(Continued)

*Primary Examiner* — Jesse S Bogue
(74) *Attorney, Agent, or Firm* — Global IP Counselors, LLP

(57) ABSTRACT

An air supercharging device is provided for an internal combustion engine. The air supercharging device includes an air inlet, an electrical compressor, a heat exchanger and a cooling circuit. The cooling circuit includes an air intake conduit and an air recirculation conduit. The intake conduit extends between the outlet of the heat exchanger and the electrical compressor. The cooling circuit is configured to capture a fraction of the cooled compressed air. The air recirculation conduit extends between the electrical compressor and adjacent an inlet of the intake manifold.

12 Claims, 1 Drawing Sheet

(56) References Cited

U.S. PATENT DOCUMENTS

| | | | | |
|---|---|---|---|---|
| 6,609,375 | B2 * | 8/2003 | Allen | F01D 15/10 60/607 |
| 6,668,553 | B1 * | 12/2003 | Ghizawi | F02B 33/44 415/111 |
| 7,056,103 | B2 * | 6/2006 | LaRue | F01D 25/125 415/4.3 |
| 7,448,212 | B2 * | 11/2008 | Wood | F02B 29/0475 60/598 |
| 7,530,230 | B2 * | 5/2009 | Shibui | F02B 37/04 290/52 |
| 8,439,019 | B1 * | 5/2013 | Carlson | F16H 7/20 123/559.1 |
| 8,544,453 | B2 * | 10/2013 | Bell | F02B 29/0437 123/559.1 |
| 2003/0051475 | A1 | 3/2003 | Allen et al. | |

* cited by examiner

AIR SUPERCHARGING DEVICE FOR AN INTERNAL COMBUSTION ENGINE

CROSS-REFERENCE TO RELATED APPLICATIONS

This application is a U.S. national stage application of International Application No. PCT/FR2017/050266, filed on Feb. 6, 2017, which claims priority to French Patent Application No. 1650972, filed on Feb. 8, 2016.

BACKGROUND

Field of the Invention

The invention generally relates to supercharging an internal combustion engine of a motor vehicle.

Background Information

In the field of internal combustion engine motor vehicles, it is known practice to supercharge the engine in order to increase its efficiency, by compressing air upstream of the intake.

To do this, the use of turbochargers, in which a compressor is driven by a turbine driven by the speed of the engine exhaust gases, is notably known.

However, the efficiency of a turbocharger is dependent on the speed of the engine exhaust gases, which means that the supercharging is not optimal when the engine is turning over at a low speed. This can be troublesome notably when a great deal of power is demanded of the engine at low speed, because it is then not possible for the engine torque to be increased rapidly.

So, it is also known practice to install, whether or not a turbocharger is present, an electric compressor in order to allow supercharging, and therefore an increase in the torque produced by the engine, notably at low speed.

Such an electric compressor comprises an electric machine formed of a stator and of a rotor, installed inside a casing, the rotor being secured to a compressor impeller by a shaft that passes through the casing. The electric compressor is therefore independent of the engine speed and can adapt to the supercharging needs of the engine, notably so as to produce more power quickly.

SUMMARY

Now, when the motor vehicle is sized in such a way that the electric compressor provides most of the additional air needed for supercharging the engine, for example when there is no turbocharger, or when the vehicle operates essentially at low speed, for example during urban-cycle driving, it may happen that the electric compressor is forced to operate uninterruptedly, or with only brief interruptions, for significant periods of time, which may cause significant heating of the electric machine.

Specifically, when the machine is used over long periods of time, the stator circuits of the machine heat up through the Joule effect, and this may cause significant and potentially irreversible damage to this machine.

So, one known problem is to find a solution to allow an electric compressor of a motor vehicle to operate for lengthy periods of time, while at the same time making sure that it does not suffer irreversible damage.

A cooling circuit for a turbocharger assisted by an electric machine is known notably from document US 2003/0051475.

In that prior-art document, a supercharging circuit comprises an air inlet which conducts a stream of external air toward the inlet of the compressor.

The compressed air leaving the compressor is conducted to the inlet of a heat exchanger, known as a charge air cooler or as an intercooler, where it can be cooled, and the cooled compressed air is then conducted to the intake manifold.

The air circuit also comprises a first air conveying pipe opening at one end at the outlet of the heat exchanger and at another end inside the casing of the electric machine.

The air circuit also comprises a second pipe opening at one end inside the casing of the electric machine and at the other end near the air inlet of the compressor.

So, through the effect of the pressure gradient between the air inlet of the compressor and the outlet of the heat exchanger, a stream of fresh compressed air is drawn into the first bypass pipe, passes through the casing of the electric machine and is drawn in by the second pipe so as to be reintroduced into the inlet of the manifold.

Because the outlet pressure of the heat exchanger is very strongly dependent on the operation of the air intake and therefore on the engine speed, such a solution is not optimal and is ill-suited to operation in a circuit comprising an electric compressor placed under heavy demand, whatever the operating speed of the engine.

So, there is a need for a more suitable cooling device for cooling an electric compressor intended to supercharge an internal combustion engine.

There is proposed a device for supercharging an internal combustion engine, comprising an air inlet, an electric compressor operated by a suitable control device, for compressing the air coming from the air inlet and a heat exchanger for cooling the compressed air coming from the compressor, the cooled compressed air flowing toward an intake manifold of the internal combustion engine, said supercharging device comprising a cooling circuit for cooling the electric compressor and/or the control device, the cooling circuit comprising an air-conveying pipe conveying air to the electric compressor and/or to the control device, extending between the outlet of the heat exchanger and the electric compressor and/or the control device, so as to be able to pick up cooled compressed air, the recirculation circuit further comprising an air recirculation pipe extending between the electric compressor and/or the control device and the vicinity of the inlet of the intake manifold.

Thus, the pressure gradient across the ends of the cooling circuit, that allows the air to be made to circulate in the cooling circuit, is dependent on the acceleration of the air as it flows between the outlet of the heat exchanger and the inlet of the intake manifold.

In this way, the cooling circuit allows the circulation of a cooled compressed air stream providing cooling of the electric compressor, even when the engine operating speed is low.

Such a device offers the advantage of making the flow rate in the cooling circuit dependent on the control current of the compressor, which defines the speed at which the compressor impeller rotates. Specifically, the higher the current, the higher will be the pressure at the outlet of the heat exchanger and therefore the higher will be the air flow rate in the cooling circuit. Also, such a device performs implicit closed-loop control of the air flow rate in the cooling circuit, making it possible to reduce the integration and development cost thereof because it does not necessarily require external closed-loop control.

Advantageously, the electric compressor comprises an electric machine installed in a casing and the cooling circuit comprises at least part of the inside of the casing. Thus, the components of the electric machine, particularly the power electronics components installed in the casing, the stator and the rotor of the electric machine can be cooled in a way that is simple and effective.

Advantageously, the control device comprises a housing in which at least one item of power electronics is housed, the cooling circuit comprising at least part of the inside of the housing.

Advantageously, the recirculation pipe opens out in the vicinity of the inlet of the intake manifold so as to form a junction orthogonal to the direction of the flow of cooled compressed air in the vicinity of said junction. Thus, the pressure gradient across the ends of the cooling circuit can be optimized in such a way as to obtain a circulation of air in the cooling circuit that is sufficient to cool the electric machine.

Advantageously, the cooling device further comprises a control means controlling the quantity of cooled compressed air allowed to circulate in said cooling circuit. Thus, the quantity of air circulating in the cooling circuit can be controlled independently of the passive circulation conditions such as the pressure gradient across the ends of the cooling circuit.

Advantageously, said control means comprises a solenoid valve. Thus there may be obtained a control means that is relatively simple to control, and reliable.

Advantageously, the solenoid valve is arranged in the cooling circuit in the vicinity of the outlet of the heat exchanger. This allows effective and high-performance mounting of the control means.

Advantageously, the electric compressor comprises means of generating a forced air stream through the cooling circuit, said means of generating a forced air stream being, for example, vanes arranged on the rotor, said vanes being able to be formed as one with the rotor according to a particular winding of the latter.

The invention also relates to a control method for controlling a supercharging device as described hereinabove, comprising steps of:

- acquiring a value indicative of the compressor temperature;
- comparing said value indicative of the compressor temperature against at least one activation value;
- determining a value for the opening of the cooling circuit,
- commanding the control means as a function of said determined opening value so as to control the quantity of cooled compressed air allowed to circulate in said cooling circuit.

Thus, the opening of the control means for cooling the electric machine can be controlled quickly and effectively.

Advantageously, the control method further comprises steps of:

- comparing said value indicative of the compressor temperature against at least one deactivation value; and
- determining a value for closing the cooling circuit, said commanding of the control means also being a function of said determined closing value.

In this way, the closure of the control means can be controlled effectively in order to maximize the availability of air for supercharging the internal combustion engine.

Advantageously, the control method comprises a step of determining a value for the pressure gradient associated with the cooling circuit, for example as a function of the difference in pressure between the vicinity of the outlet of the heat exchanger and the pressure at the junction in the vicinity of the inlet of the intake manifold, the commanding of the control means also being a function of a closure command determined so that, when the determined pressure gradient value is below a predetermined threshold value, the control means at least partially prevents the circulation of cooled compressed air in the cooling circuit. Thus it is possible to create an artificial pressure drop that encourages the circulation of air in the cooling circuit, even when the pressure gradient across the ends of the cooling circuit is low.

The invention relates to a supercharging assembly comprising a supercharging device as described hereinabove and a control member designed to implement the control method.

The control member may for example be an onboard computer, a microprocessor or, for example, the control unit of the electric compressor.

The invention further relates to a motor vehicle comprising a supercharging device as described hereinabove.

BRIEF DESCRIPTION OF THE DRAWINGS

Other particular features and advantages of the invention will become apparent from reading the description given hereinafter of one particular embodiment of the invention, given by way of nonlimiting indication, with reference to the attached drawings in which.

BRIEF DESCRIPTION OF THE DRAWINGS

Figure 1:
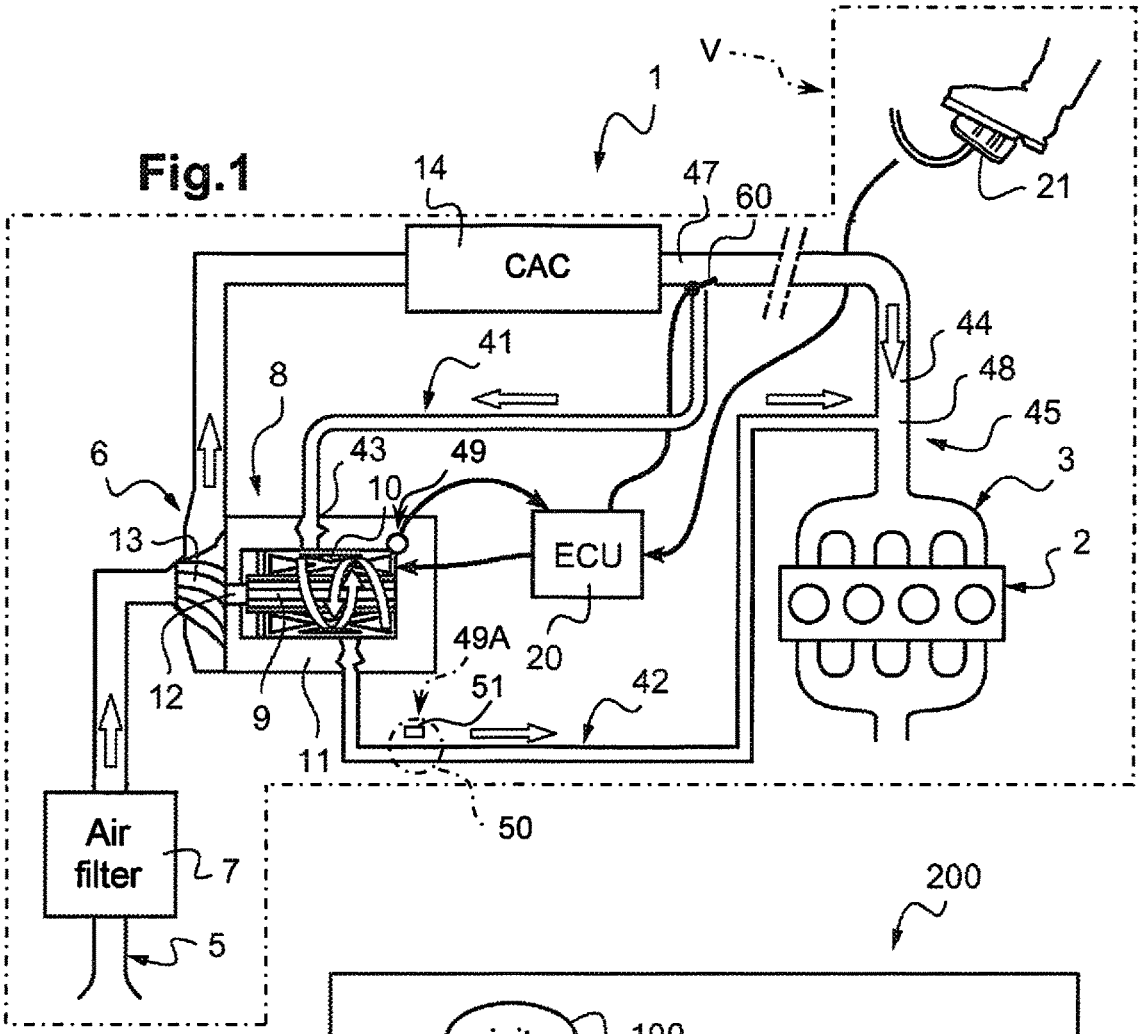
FIG. 1 is a schematic depiction of a supercharging device according to one embodiment of the invention.
Figure 2:
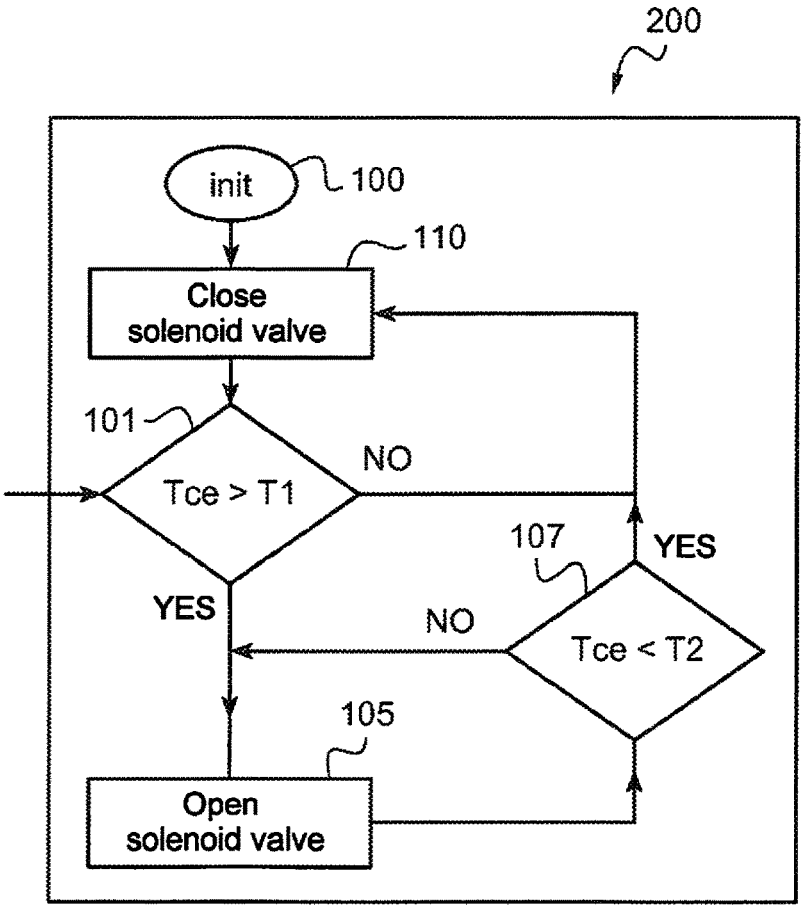
FIG. 2 is a schematic depiction of a control method for controlling a supercharging device according to the embodiment of FIG. 1.

With reference to FIG. 1, a supercharging device 1 for supercharging an internal combustion engine 2 comprises an air inlet 5 and a compressor 6.

Through the remainder of the description, the supercharging device 1 and the engine 2 are installed in a motor vehicle V. However, the invention is not restricted only to motor vehicles, and relates to any installation of a supercharging device 1 for an internal combustion engine 2.

The compressor 6 receives air coming from the air inlet 5 after it has passed through an air filter 7. The air filter 7 filters out any solid particles that may be carried by the air and that may could damage the compressor 6.

Air entering via the air inlet 5 generally comes from outside the assembly in which the supercharging device 1 and the engine 2 are installed, for example from outside a motor vehicle. This air is therefore generally at atmospheric pressure and at ambient temperature.

In particular, the air inlet may be installed on the front face of the motor vehicle, in order to pick up air dynamically, or alternatively at the bottom of the windshield, making it possible at these locations to obtain a maximum dynamic air pressure.

The compressor 6 here is an electric compressor 6 which comprises an electric machine 8 installed in a casing 11 and formed of a stator 10 and of a rotor 9.

Alternatively, the compressor 6 may be a turbocharger assisted by an electric machine, the electric machine then taking over from the turbine of the turbocharger to drive the compression impeller when the engine is operating at low speed. Implementation of this alternative can then simply be adapted for cooling the electric machine.

The rotor 9 is installed inside the stator 10 in such a way as to be able to be rotated by the electromagnetic field produced by this stator 10.

A shaft 12 is secured to a first end of the rotor 9 and passes through the casing 11 so as to be secured at another end to a compressor impeller 13. The rotor 9 turns the shaft 12 which in turn turns the compressor impeller 13.

When the compressor impeller 13 is actuated, air coming from the air inlet 5 is compressed, and therefore heats up.

In this instance, the compressor 6 is controlled by an onboard control unit 20.

The onboard control unit 20 receives a value for the demand for power from the engine 2, for example as a function of the force produced by the user of the motor vehicle on the throttle pedal 21 or of the position imparted by the user to said throttle pedal 21.

Depending on the operating speed of the engine 2, the onboard control unit 20 calculates the torque needed in order to quickly obtain the demanded power.

If the requirement for torque is higher than the engine 2 produces without supercharging, then the onboard control unit actuates the compressor 6 so that it supplies the engine 2 with enough supercharged air to increase the torque produced.

The air thus compressed, which was heated up as it was compressed, is conducted toward a heat exchanger 14, in this instance a charge air cooler 14, also known as an intercooler, so that the compressed air can be cooled.

The cooled compressed air leaving the heat exchanger 14 flows as far as the intake manifold 3 of the engine 2 so that it can be injected into the cylinders of the engine 2.

The supercharging device 1 also comprises a cooling circuit 41, 42 for cooling the compressor 6.

The cooling circuit 41, 42 is formed of an air conveying pipe 41 and of an air recirculation pipe 42.

The cooling circuit 41, 42 therefore constitutes a circuit 41, 42 parallel to the main supercharging circuit 44 described hereinabove.

The pipes of the cooling circuit 41, 42 may be fixed to the main circuit 44 by threading, by force-fitting onto rigid or straight pipes, for example provided with recesses, or alternatively locked by collars.

The pipes of the cooling circuit 41, 42 may be made of any suitable material, for example reinforced silicone rubber, having for example a metal, Teflon or nylon braid. In general, each pipe of the cooling circuit may be made from at least one material or a combination of materials which is capable of thermally insulating the cooled air stream circulating through the pipes from the high-temperature environment that the engine compartment represents. The aim of that is to keep the stream of air intended for cooling the compressor at a constant temperature.

The air conveying pipe 41 is designed to supply fresh air capable of cooling the electric machine of the compressor 6.

In this instance the air conveying pipe 41 extends between the outlet 47 of the heat exchanger 14 and the compressor 6.

In particular, the air conveying pipe 41 enters the casing 11 of the electric machine 8 so as to bring the air that opens out into the casing 11 into contact notably with the stator 10 and with the rotor 9, but also with the space inside which the power electronics components of a control device 49 that manage the power introduced into the stator or the rotor depending on the design technology of the electric motor are housed, so as to cool these by exchange of heat.

According to an alternative form of embodiment of the invention, a control device 49A shown by in dashed-dotted lines in FIG. 1 is provided that has a dedicated housing 50 and power electronics 51. Here, the control device 49A comprising the power electronics 51 is sited remotely away from the electric machine 8 (the rotor 9 and the stator 10). For example, in an arrangement whereby the power devices are housed in the dedicated housing 50 separate from the casing 11, the cooling circuit 41, 42 incorporates said housing 50 in so far as the latter defines part of the pipe along which the cooling air flows. The depictions of the housing 50 and the power electronics 51 are diagrammatic and are not meant convey any specific location of the control device 49A in the cooling circuit 41, 42.

An air recirculation pipe 42 is installed which extends between the inside of the casing 11 of the electric machine 8 and the vicinity of the inlet 45 of the intake manifold 3.

The recirculation pipe 42 opens out at a point 48 of junction into the main circuit 44, orthogonal to the direction of the stream of air circulating in the main circuit 44 at the point 48 of junction with the recirculation pipe 42.

This junction point 48 will be chosen so that the air circulating in the main circuit 44 at this junction point 48 exhibits a substantially maximum speed.

If the point on the main circuit 44 that exhibits a substantially maximum air circulation speed cannot be determined, then the junction point 48 will be chosen so that it is as far away as possible from the outlet 47 of the heat exchanger 14 and therefore as close as possible to the intake manifold 3.

The recirculation pipe 42 first of all allows air that has been used to cool the electric machine 8 to be reintroduced upstream of the intake manifold 3, making it possible to preserve the overall air flow rate at the inlet of the intake manifold 3.

Furthermore, since, from a generalized viewpoint, the casing 11 forms a substantially airtight enclosure, the pressure gradient between the vicinity of the inlet 45 of the intake manifold 3 and the outlet 47 of the heat exchanger 14 makes it possible to obtain a depression that causes the air to circulate in the cooling circuit 41, 42 from the outlet 47 of the heat exchanger 14 to the vicinity of the inlet 45 of the intake manifold 3 so as to create a cooling air stream inside the casing 11 of the electric machine 8.

Specifically, the air flowing between the outlet 47 of the heat exchanger 14 and the intake manifold 3 in the main circuit 44 is accelerated.

So, by applying Bernoulli's theorem, the air accelerated in the vicinity of the inlet of the intake manifold 3 is at a lower pressure than the slower air in the vicinity of the outlet 47 of the heat exchanger 14, which means that the air can be drawn into the parallel cooling circuit 41, 42.

The acceleration of the air can be produced by the special shape of the intake manifold 3 or of the main circuit 44, although if the air is not naturally accelerated in the portion of main circuit 44 between the outlet 47 of the heat exchanger 14 and the vicinity of the inlet 45 of the intake manifold 3, a Venturi device may be installed between the heat exchanger 14 and the inlet of the intake manifold 3, in the main circuit 44, so as to force the air to accelerate and create a pressure gradient that encourages the circulation of air in the cooling circuit 41, 42.

It is also possible, according to an alternative which has not been depicted, to install a vaned compressor impeller in the casing 11 of the electric machine 8 so as to create a phenomenon whereby air is pumped in the air conveying pipe 41 and so as to accelerate the rate of flow of cooling air.

In this case, the supercharging device comprises, at the level of the electric compressor 6, means of generating a forced air stream through the cooling circuit 41, 42. By way of examples, said means of generating a forced air stream may be vanes arranged at the periphery of the rotor. According to one alternative form of embodiment of these vanes, they may be formed as an integral part of the rotor according to a special winding thereof. Alternatively, setting the rotor into rotation causes the vanes to move, thereby forcing the air to circulate in the pipes of the cooling circuit 41, 42.

In the embodiment according to FIG. 1, the cooling circuit 41, 42 comprises a means 60 of controlling the air flow rate.

The control means 60 here is a solenoid valve 60 installed in the vicinity of the end of the air conveying pipe 41 that opens out in the vicinity of the outlet 47 of the heat exchanger 14.

According to an alternative, the control means 60 may comprise a membrane or a valve needle, installed in the cooling circuit 41, 42 in the vicinity of the electric machine 8 and coming to sealingly block the cooling circuit 41, 42. The valve needle or membrane is mechanically connected to a spring bearing against the air conveying circuit 41, the expansion of which causes an increase in length so that it applies a force that moves the membrane or valve needle away, thus opening a passage for said fluid. The spring is sized in such a way that the circuit is open when the temperature of the electric compressor 6, which temperature has caused the spring to expand, corresponds to a threshold T1 for triggering cooling.

In the main mode, the solenoid valve 60 may be controlled by an independent control member 20 or may be controlled directly by the onboard control unit 20 that controls the compressor 6.

The solenoid valve 60 is designed to move from an open position in which the air is free to pass into the cooling circuit 41, 42 to a closed position that prevents air from passing into the cooling circuit 41, 42. The solenoid valve 60 is also designed to adopt several intermediate positions modulating the air flow rate allowed in the cooling circuit 41, 42.

In particular, when the compressor 6 has an operating temperature that does not require active cooling, the solenoid valve can be positioned in a closed position. In this way, no pressure drop is produced at the main supercharging circuit 44, and operation of the engine 2 is, in this respect, optimal.

One method for controlling the solenoid valve 60 which is implemented by the control member 20 comprises a first step in which, for each instant t, a value indicative of the temperature Tce of the electric machine 8 of the compressor 6 is received 100 and, for the sake of legibility, this temperature will be referred to as the temperature Tce of the electric machine 8.

The temperature Tce of the electric machine 8 may be supplied by a temperature sensor installed in the casing 11 of the machine 8.

According to one alternative, the temperature Tce of the electric machine 8 may be obtained by a calculation means, for example a microprocessor, designed to calculate, as a function of engine speed, of compressor operation and of any other suitable parameter, an estimated and/or predictive value of the temperature Tce of the electric machine 8 in the subsequent instances.

According to another alternative, a calculation means, for example a microprocessor, may use a suitable thermal dissipation model to predict the heating of the electric machine, in order to anticipate the regulation of the opening of the solenoid valve 60, in order to optimize the regulation of the temperature Tce in the casing 11 of the electric machine 8.

If the solenoid valve 60 is in a closed position, then the temperature Tce of the electric machine 8 is next compared 101 against an upper limit temperature T1, referred to as the activation temperature T1, for example an activation temperature T1 comprised between 60° C. and 150° C.

If the temperature Tce of the electric machine 8 exceeds the activation temperature, the opening of the solenoid valve 60 is commanded 105 so as to allow the circulation of air in the cooling circuit 41, 42, which is below 50° C. The heat exchanger 14 may be an exchanger of water/air type, in as much as the cooling water circuit is a cooling circuit said to be a low temperature circuit, the water temperature not exceeding 60° C., preferably being 50° C., as compared with a cooling circuit said to be a high temperature circuit, such as the engine cooling circuit, the cooling fluid of which approaches a temperature of between 90° C. and 120° C. According to an alternative form of embodiment, the heat exchanger 14 may be of the air/air type arranged on the front face of the motor vehicle so as to draw cold energy from the air to cool the compressed air.

If the solenoid valve 60 is in an open position, then for each instant t, the value of the temperature of the electric machine 8 is compared 107 against a deactivation value T2, for example a temperature value comprised between 40° C. and 80° C.

If the value of the temperature of the electric machine 8 is below the deactivation temperature T2, then closure of the solenoid valve 60 is commanded 110.

In this embodiment, the deactivation value T2 is lower than the activation value T1 so as to ensure sufficient cooling of the electric machine 8.

It is also possible to foresee a plurality of activation temperature values T1, each activation temperature value T1 defining a different intermediate opening position of the solenoid valve 60, such that each activation value T1 allows a flow rate corresponding to a different fraction of the maximum possible flow rate in the cooling circuit 41, 42 when the solenoid valve 60 is in the fully open position. So, the higher the activation temperature value T1, the greater the extent to which the solenoid valve 60 is open.

It is also possible to foresee a plurality of deactivation values so as to reclose the solenoid valve 60 gradually as the electric machine 8 cools.

In this way, it is possible to control the air flow rate allowed in the cooling circuit 41, 42 so as to maximize the circulation of cooled compressed air in the main circuit 44 according to the cooling requirements of the electric machine 8.

According to one alternative, the pressure gradient across the ends of the cooling circuit 41, 42 is calculated, for example, as a function of the pressure values measured or estimated in the vicinity of the outlet 47 of the heat exchanger 14, of the pressure at the junction 48 in the vicinity of the inlet 45 of the intake manifold 3, and of the length of the main circuit 44.

If the calculated gradient has a value comprised between of the order of 10 and 300 mbar, partial closure of the control means 60, in this instance the solenoid valve, is commanded so as to create a pressure drop, so that through a Venturi effect the flow rate of air in the main circuit 44 in the vicinity of the inlet 45 of the intake manifold 3 causes air to be drawn into the cooling circuit 41, 42.

It is also possible to provide in the control method a criterion that consists in preventing the passage of air into the cooling circuit 41, 42 when a very high demand for power is placed on the engine, in order not to restrict the control of the vehicle.

According to another alternative, provision may be made for the opening and closing of the solenoid valve 60 to be controlled as a function of a hysteresis calibrated from predetermined electrical machine temperature values Tce.

While still remaining within the scope of the invention, the device for supercharging an internal combustion engine may also comprise a traditional compressor in addition to the electric compressor 6, each one preferably operating at distinct load points of the internal combustion engine 2.

The pipe supplying the electric compressor 6 with cooled air is preferably a tapping made near the exchanger 14 or even, according to one embodiment, comprised directly within the outlet header of the exchanger 14 which then comprises a main air outlet 47 and a secondary outlet via which cooling air can pass toward the electric compressor 6 or the control device that is to be cooled. According to an alternative form of embodiment which has not been depicted, the air flow rate control means comprising the valve 60 may be incorporated directly into the exchanger 14, for example by molding an outlet header.

The invention claimed is:

1. A supercharging device for supercharging an internal combustion engine, the supercharging device comprising:

an air inlet, an electric compressor arranged to compress air coming from the air inlet;

a heat exchanger arranged to cool compressed air coming from the compressor, the cooled compressed air flowing toward an intake manifold of the internal combustion engine; and a cooling circuit arranged to cool at least one of the electric compressor and a control device of the electric compressor, the cooling circuit comprising an air-conveying pipe arranged to convey air to at least one of the electric compressor and the control device, the air-conveying pipe extending between an outlet of the heat exchanger and at least one of the electric compressor and the control device, so as to be able to pick up cooled compressed air, and an air recirculation pipe extending between at least one of the electric compressor and the control device and adjacent an inlet of the intake manifold.

2. The supercharging device as claimed in claim 1, wherein the electric compressor comprises an electric machine (8) installed in a casing, and the cooling circuit comprises at least part of an inside of the casing.

3. The supercharging device as claimed in claim 1, wherein the control device comprises a housing in which at least one item of power electronics is housed, and in that the cooling circuit comprises at least part of an inside of the housing.

4. The supercharging device as claimed in claim 1, wherein the recirculation pipe opens out adjacent the inlet of the intake manifold so as to form a junction orthogonal to a direction of a flow of the cooled compressed air adjacent the junction.

5. The supercharging device as claimed in claim 1, and further comprising a control means arranged to control a quantity of the cooled compressed air allowed to circulate in the cooling circuit.

6. The supercharging device as claimed in claim 5, wherein the control means comprises a solenoid valve.

7. The supercharging device as claimed in claim 6, wherein the solenoid valve (60) is arranged in the cooling circuit adjacent the outlet (47) of the heat exchanger.

8. The supercharging device as claimed in claim 1, wherein the electric compressor comprises a rotor having vanes that generate a forced air stream through the cooling circuit.

9. A control method for controlling the supercharging device as claimed in claim 5 and further comprising:

acquiring a value indicative of a compressor temperature gee);

comparing the value indicative of the compressor temperature against at least one activation value;

determining an opening value for opening of the cooling circuit, commanding the control means as a function of the opening value that was determined so as to control the quantity of the cooled compressed air allowed to circulate in the cooling circuit.

10. The control method as claimed in claim 9, and further comprising comparing the value indicative of the compressor temperature against at least one deactivation value;

determining a closing value for closing the cooling circuit, the commanding of the control means also being a function of the closing value that was determined.

11. The control method as claimed in claim 9, and further comprising determining a pressure gradient value for a pressure gradient associated with the cooling circuit, the commanding of the control means also being a function of the pressure gradient value, so that when the pressure gradient value is below a predetermined threshold value, the control means at least partially prevents circulation of the cooled compressed air in the cooling circuit.

12. A motor vehicle comprising the supercharging device as claimed in claim 1.

* * * * *